United States Patent [19]

Ferrin

[11] Patent Number: 4,911,038

[45] Date of Patent: Mar. 27, 1990

[54] MULTI-PURPOSE DEVICE FOR OPENING CONTAINERS

[76] Inventor: Kenneth M. Ferrin, Gracy La., East Hampton, N.Y. 11937

[21] Appl. No.: 393,538

[22] Filed: Aug. 14, 1989

[51] Int. Cl.[4] ..... B67B 7/44

[52] U.S. Cl. ..... 81/3.09; 81/3.4; 81/3.55; 225/93

[58] Field of Search ..... 81/3.07, 3.09, 3.4, 81/3.55, 3.47, 3.29, 176.15, 176.2; 225/93; 7/151; 30/1.5

[56] References Cited

U.S. PATENT DOCUMENTS

| | | | |
|---|---|---|---|
| 2,459,610 | 1/1949 | Zadina | 81/176.15 |
| 3,812,741 | 5/1974 | Heine | 81/3.4 |
| 4,455,894 | 6/1984 | Roberts | 81/3.09 |
| 4,723,465 | 2/1988 | Hughes | 81/3.09 |
| 4,790,220 | 12/1988 | Lloyd | 81/3.09 |

*Primary Examiner*—Roscoe V. Parker
*Attorney, Agent, or Firm*—Schweitzer & Cornman

[57] ABSTRACT

A multi-purpose device is disclosed for opening a variety of containers, such as plastic milk jugs, soda cans and soda bottles. A cup-like guide member is received over the tamper-resistance cap of a plastic milk jug and has cleaving lugs projecting downward into the spaces between rupturable connector elements, which join the threaded cap to a fixed locking collar. By twisting the guide member, the cleaving lugs are caused to rupture the connector elements and free the cap for easy removal. A handle provides leverage to facilitate application of the necessary twisting torque. A smaller cup-like section, co-axial with the cup-like guide member but of smaller diameter, is provided with ribbed side walls for engagement with the flutes of a standard twist-off bottle cap to facilitate its removal by twisting. Preferably, the outer end of the handle is provided with a thinned-down portion adapted to be slipped under the lift tab opener of a standard soda can enabling the lift tab to be raised easily by a lifting/prying action of the handle.

10 Claims, 2 Drawing Sheets

MULTI-PURPOSE DEVICE FOR OPENING CONTAINERS

BACKGROUND AND SUMMARY OF THE INVENTION

The present invention relates to a multi-purpose device for opening various containers, especially liquid containers such as gallon-size milk jugs, bottles with twist-off caps, and cans with lift-tab openers. All of the foregoing container types are in relatively widespread use and tend to require a degree of manual dexterity and strength to be opened. Many individuals have difficulty in opening some or all of these containers without tools, and frequent resort is to makeshift implements in order to obtain access to the contents of the container.

Milk and other liquid products are frequently sold in gallon or half gallon size plastic jugs, provided with tamper-resistant plastic caps. Typically, these cap assemblies are comprised of a threaded closure cap which is joined by integral, rupturable connector elements to a locking collar. The locking collar is designed to be non-rotatable on the container or otherwise to prevent removal of the threaded cap once the assembly of cap and collar has been applied to the container. Removal of the threaded cap requires breaking of the rupturable connectors, which man people find to be very difficult without the aid of a tool.

One of the objectives of the invention is the provision of a novel, highly simplified, economically manufactured device that greatly facilitates opening of plastic jugs provided with tamper-resistant cap assemblies. To this end, the device of the invention includes a guide member, typically in the form of an inverted cup, which is received over the threaded cap element of the tamper-resistant closure assembly. The guide member has a plurality of cleaving lugs, which extend downward into spaces between the several rupturable connectors joining the threaded cap element with the associated locking collar. When the guide member is rotated, the cleaving lugs engage and rupture the connector elements, so that the threaded cap element is freed for easy removal. To advantage, the guide member is integrally associated with a radially extending handle portion, providing sufficient leverage to the guide member so that the torque necessary for breaking the rupturable connector elements can easily be applied by a person possessing the most modest strength and dexterity.

In accordance with another aspect of the invention, the main body of the multi-purpose opening device is arranged in a two-stage cup-like configuration. The first stage is a relatively large diameter guide member for use in opening tamper-resistant caps for large jugs, as described in the preceding paragraph. Concentrically associated therewith, directly above and opening into the last mentioned guide member, is a gripping member of generally inverted cup-like configuration. The gripping member is provided with ribbed side walls arranged to be received in gripping relation to a standard twist-off bottle cap. Thus, the body of the device may be applied over the top of a container provided with twist-off cap and then rotated. The integral handle, desirably provided, allows the necessary opening torque to be easily applied. To advantage, the cup-like gripping portion is provided with an opening in its upper wall through which a thumb or finger may be projected to dislodge a cap after removal from its container.

In accordance with a further aspect of the invention, the integral handle portion, advantageously provided to increase the ease in which a user may apply opening torque to either a twist-off cap or a tamper-resistant jug cap, is in itself provided with a facility for simplifying the opening of lift tab devices, commonly used in the packaging of canned beverages, for example. Typically, a lift-tab opener includes a lift tab element which normally is disposed tightly against the top surface of the container. The lift tab can b raised by inserting fingernails under the lift tab and applying upward force with the fingers, causing a portion of the container lid to break-away and pivot inwardly of the container. The initial lifting of the tab element is sometimes difficult and not infrequently causes damage to the fingernails. According to the invention, the handle member, otherwise provided on the opener, is formed with a thinly tapered outer end extremity, which is easily inserted underneath the lift tab element of a beverage can to enable the tab to be raised by a lifting/prying action of the handle. With the increased force and leverage of the prying handle the tab is easily lifted, and the breaking-away of the opening element of the can is accomplished. The lift tab is left projecting upwardly at a convenient angle to be engaged by the fingers to complete the opening. A small narrow tab, which projects outwardly from the end of the handle extremity, facilitates the initial engagement and raising of the lift tab and enables the broader, tapered portion of the handle to be more easily inserted under the lift tab.

Additionally, the small, narrow tab, referred to above, can be used to advantage in the opening of milk jugs and like provided with tamper-resistant closures of the type having a pull tab element for releasing the cap for removal. For closures of that type, the small tab, projecting from the end of the device handle, can be inserted in slot at the end of the closure pull tab. The handle is then twisted and/or pried to break the pull tab free. Thereafter, the pull tab can be easily pulled by hand to free the cap.

For a more complete understanding of the above and other features of the invention, reference should be made to the following detailed description of a preferred embodiment of the invention, and to the accompanying drawings.

DESCRIPTION OF THE PREFERRED EMBODIMENT OF THE INVENTION

Figure 1:
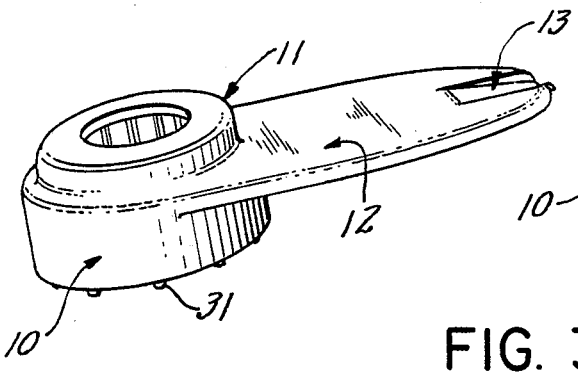
FIGS 1 and 2 are perspective views, from above and below respectively, of a particularly advantageous form of the invention.
Figure 2:
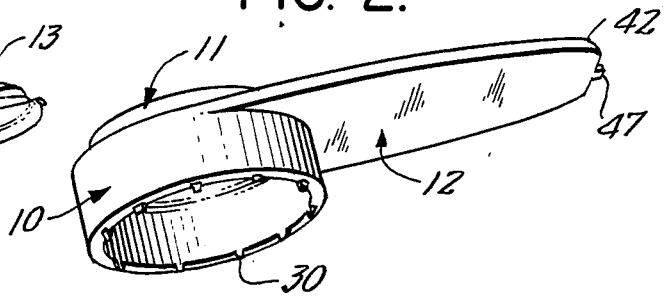

Referring now to the drawings, the multi-purpose opening device of the invention advantageously is made in the form of a unitary, injection molded plastic device of a suitable structural plastic material, such as ABS. The device includes a first, generally circular guide portion 10 of inverted, cup-shaped configuration. Directly above the guide portion 10, and concentrically aligned therewith, is a second generally cup-shaped circular portion 11, forming a gripping means for a twist-off cap. Projecting radially outwardly from the circular portions 10, 11 is a integral handle portion 12 provided at its outer extremity with a tab lifting portion 13.

Figure 7:
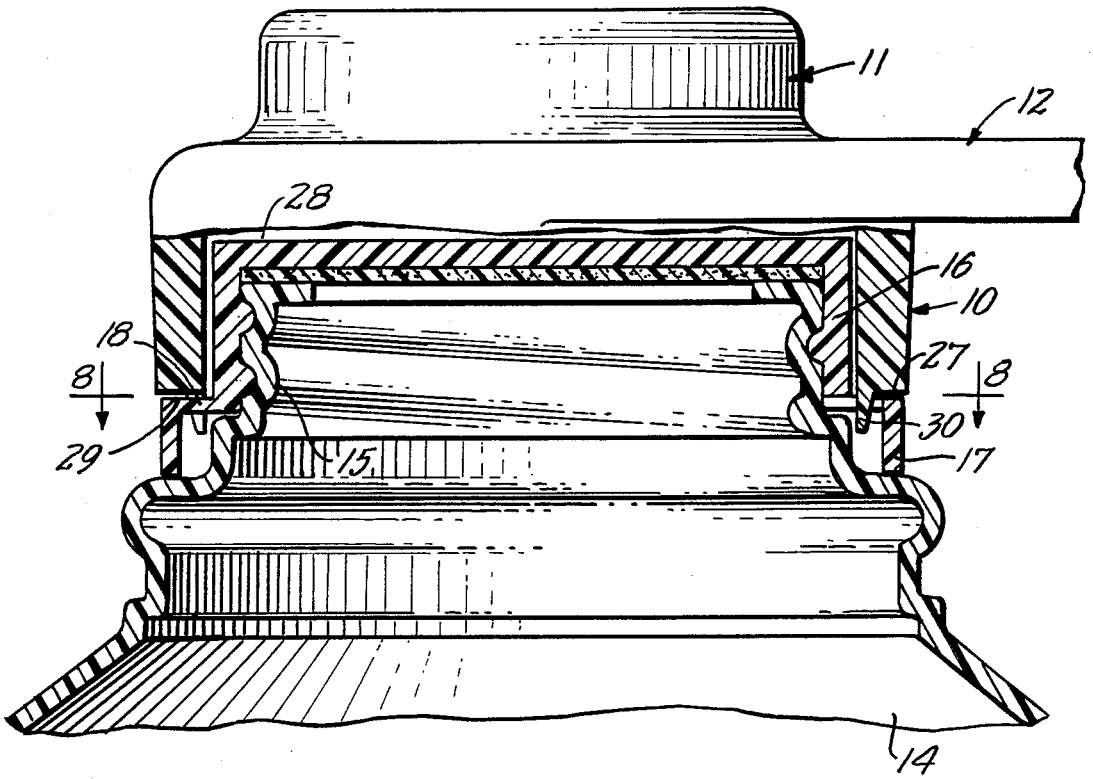
FIG. 7 is an enlarged, fragmentary view of the device of the invention, taken in partial cross section generally on the line 7—7 of FIG. 8.
Figure 8:
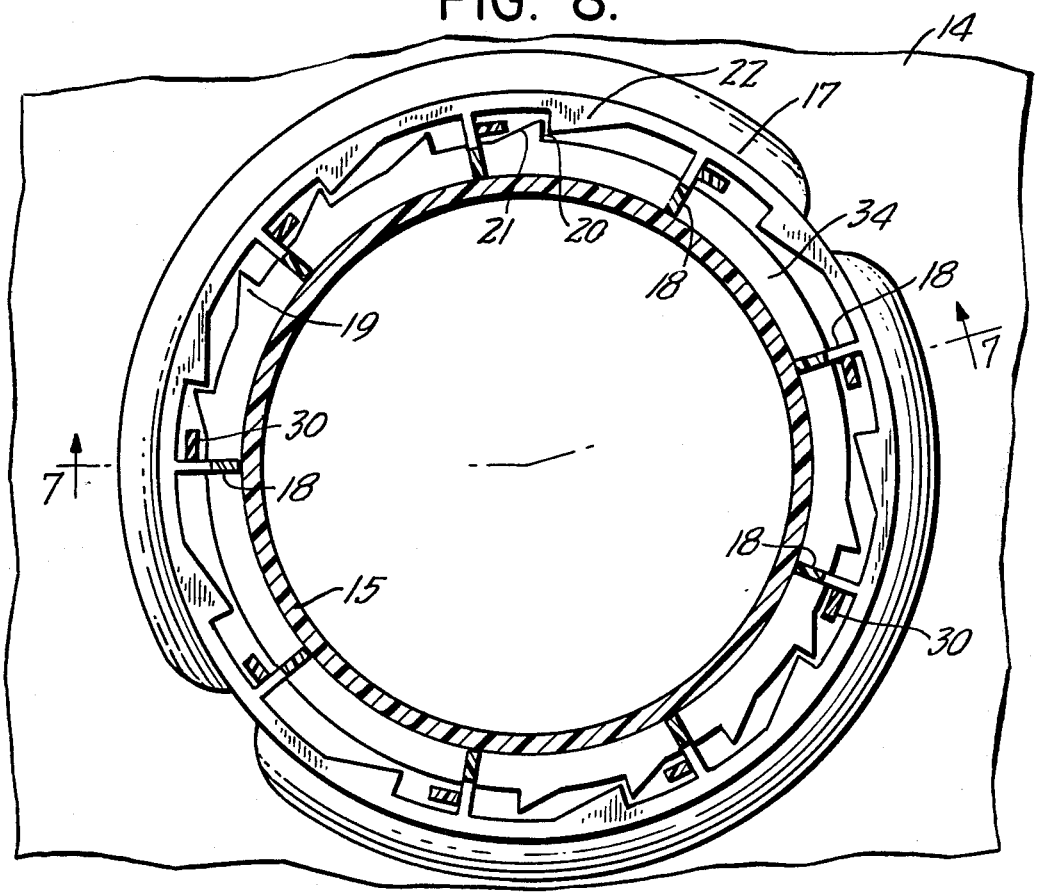
FIG. 8 is a cross sectional view as taken generally on line 8—8 of FIG. 7.

One of the particularly advantageous features of the device of the present invention relates to its utilization in the opening of tamper-resistant cap assemblies for plastic milk jugs and the like, illustrated in FIGS. 7 and 8 of the drawings. A relatively common form of plastic jug 14 is provided with a threaded pour opening 5 engageable with a correspondingly threaded plastic cap element 16. Pursuant to conventional practice (forming no part of the present invention), the threaded plastic cap element 16, when initially applied to the plastic jug 14, is provided wit an annular locking collar 17. The collar is attached to the lower edge of the threaded cap element cap 16 by means of a plurality of circumstantially spaced, rupturable connector elements 18. The arrangement is such that the cap element 16 and locking collar 17 initially constitute a single integral entity.

Externally, the neck portion of the plastic jug 14 is provided with a plurality of wedge shaped rachet teeth 19, all facing in the same direction, i.e., with relatively radially disposed faces 20 facing in a clockwise direction, and connected to inclined surfaces 21 facing generally in the opposite direction. The locking collar 17, on the other hand, is provided with plurality of integral inwardly projecting wedge like elements 22, oriented generally in the opposite direction. The arrangement is such that the threaded cap element 16, with its integrally attached locking collar 17, may be easily applied to the pouring neck of the plastic jug by rotating the cap element 16 to cause the cap portion to be tightened dow on the jug to close and seal the same. Once applied and tightened, however, the wedge like projections 19, 22 prevent reverse rotation of the locking collar and thus prevent removal of the cap element 16 without destruction of the rupturable connectors 18.

Opening of the plastic jug 14 can be accomplished by applying sufficient rotational torque to the cap element 16 in the opening direction. However, many individuals do not have the hand strength to apply the necessary torque, and frequently resort is had to some kind of makeshift tool to break the locking collar.

Pursuant to the invention, a novel form of opening the device is provided which enables the rupturable connector elements to be easily broken, freeing the threaded cap 16 from the locking collar and allowing it to be easily removed from the container. To this end, the guide portion 10 of the opening device is designed to be received over the threaded cap member 16, advantageously with at least a slight clearance, so that the guide member is rotatable freely with respect to the threaded cap element. In the illustrated device, the guide member 10 is provided with a downwardly projecting cylindrical wall 25 which is open at the bottom and limited at the top by a shoulder 26. To advantage, the depth of the cylindrical wall 25, from its lower edge 27 to the shoulder 26, is slightly greater than the height of the threaded cap element 16, as measured from a horizontal shoulder 29 defined by the outwardly extending connector elements 18 together with the upper surface of the locking collar 17. This enables the bottom surface 27 of the guide member 10 to be seated on the locking collar 17 when the guide member is applied over the top of the threaded cap.

In accordance with one aspect of the invention, a plurality of integral cleaving lugs 30 are formed on the guide member 10 and project downward from the lower edge 27 thereof adjacent the inner surface 31 of the cylindrical wall. The number of lugs provided is not particularly significant, although it is preferable to have several such lugs, spaced relatively uniformly about the circumference of the cylindrical wall 25. Adequate separation is provided between adjacent lugs to enable them to be easily inserted into the spaces between adjacent connector elements 18 joining the threaded cap 16 with the locking collar 17. In the illustrated device, there are conveniently provided nine equally space lugs.

Figure 3:
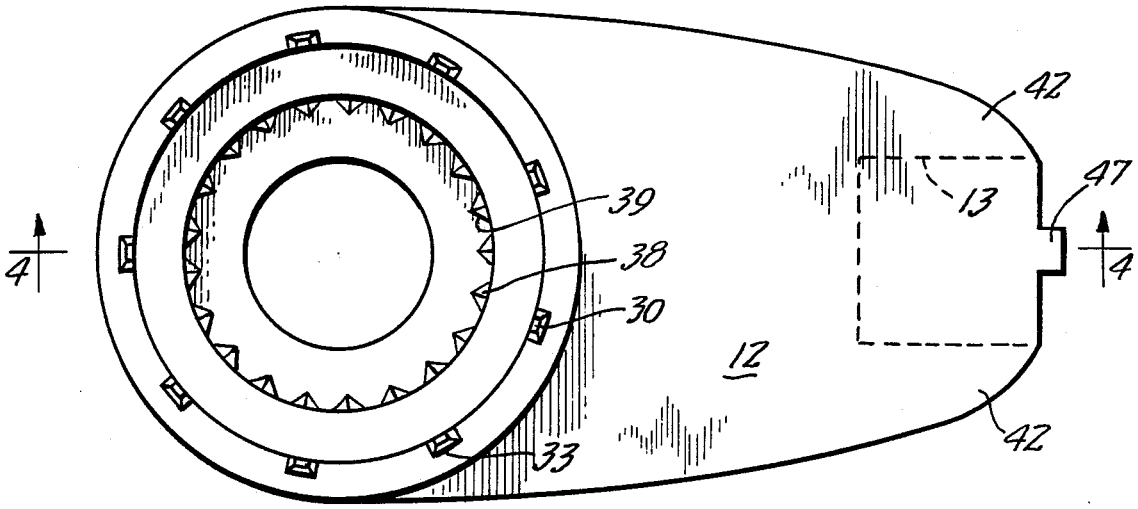
FIG. 3 is a bottom plan view of the device of FIGS. 1 and 2.
Figure 4:
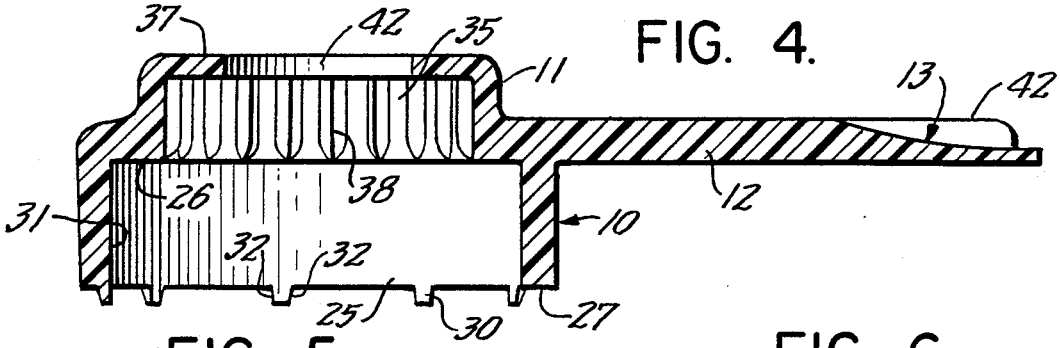
FIG. 4 is a cross sectional view of the device of the invention, as taken generally on line 4—4 of FIG. 3.

Desirably, the cleaving lugs 30 are relatively thin in radial dimension and somewhat wider in a circumferential direction, as is evident in FIG. 3. The side edges 32 of the cleaving lugs 30 are tapered convergently from the base to the free ends thereof, and the outwardly facing surfaces 33 of the lugs also may taper slightly from the base to the tips of the lugs The arrangement is such as to facilitate entry of the free ends of the cleaving lugs into the open spaces 34 between adjacent connector elements of the cap assembly.

Once the opening device is seated on the cap assembly, in the manner shown in FIG. 7, the bottom surface 27 of the guide member 00 seats on the shoulder 29 of the locking collar 17. The cleaving lugs 30 project through the open spaces 34, inside the locking collar 17, and extend below the rupturable connector elements 18. Now, upon rotation of the guide member 10, the edges of the cleaving lugs 30 are brought up against the rupturable connector elements 18, and with the application of sufficient torque to the guide member, the connector elements 18 are severed. As will be readily understood, the presence of the radially extending handle portion 12 allows significant torque to be applied to the opening device, without relying exclusively on the gripping and squeezing power of the user. Rupturing of the connector elements is thus very quickly and easily accomplished, after which the threaded cap element 16, now freed from its locking collar, is easily removed manually from the plastic container.

Although it is to be understood that specific dimensions are not critical to the invention, and the invention is not to limited thereby, in one advantageous form of the device according to the invention, the diameter of the cylindrical wall 25 may be approximately 1.63", and its height approximately .485". These dimensions preferably provide a slight clearance about the exterior of the threaded cap 16, so that torque applied to the device is devoted exclusively to rupturing of the connector elements 18 The cleaving lugs typically may have a projecting length of about 0.067", with a root dimension of about 0.118" and side walls 32 tapered at about 25 degrees from the vertical. The thickness of the lugs typically is substantially less than that of the cylindrical wall 25, and in a root thickness on the order of 0.025"

may be adequate depending upon the particular material of construction.

Figure 5:
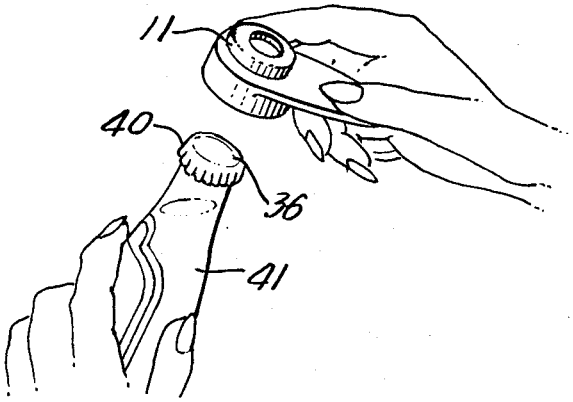
Fig. 5 is a perspective view showing the manner in which the device of the, invention may be used in the opening of a bottle provided with a twist-off cap.

An additional important utility of the device of the invention is in the opening of twist-off bottle caps. For this purpose, the gripping portion 11 is molded integrally with the guide member 10, preferably directly above and concentrically therewith. The gripping portion 11 s provided with a generally cylindrical wall 35 of a diameter and height suitable to fit easily over he top of a twist-off cap 36 (see FIG. 5). To this end, the internal diameter of the wall 35 may be on the order of 1.192", with a height of approximately 0.330". The upper end of the inverted, cup-shaped gripping portion 11 is defined by a shoulder-forming wall 37. The cylindrical wall 35 of the gripping portion is provided with a plurality of closely spaced, longitudinally extending ribs 38 of generally triangular cross section. The dimensioning and spacing of the flutes is of course a function of the configuration of conventional twist-off bottle caps 36. To this end, the illustrated form of the invention utilizes twenty-one equally spaced ribs 38, each having a root dimension of about .103" with side walls 39 tapering at an angle of approximately 45 degrees to the radius.

In order to remove a twist-off bottle cap 36, the multi-function opening device is applied over the top of the capped bottle (see FIG. 5) until the cap 36 is seated within the gripping portion 11, with the ribs 38 engaged with the flutes 40 of the bottle cap. Wit the bottle cap thus tightly gripped, torque is applied to the device, with the aid of the handle 12, to easily apply the break-away torque to release the cap and enable it to be quickly removed from the bottle 41.

To facilitate removal of the cap 36 from the gripping section 11, the shoulder-forming top wall 37 is provided with a central opening 42, which is sufficiently large for a user-to insert a thumb or finger to dislodge the cap.

A still further advantageous function of the device of the invention may be realized through the use of the handle 12. At the outer extremity of the handle, there is provided a central, broad tapered section 13. In one advantageous form of the invention, the handle may have a basic thickness of about 0.157", and the outer section 13 may be tapered down to a thickness of about 0.04" for a distance of, for example, 0.7". Desirably, however, the side margins 42 of the handle, on each side of the tapered portion 13, are of full thickness, so as to apply more gentle pressure to the hand of the user during the application of torque for opening of bottles or jugs.

Figure 6:
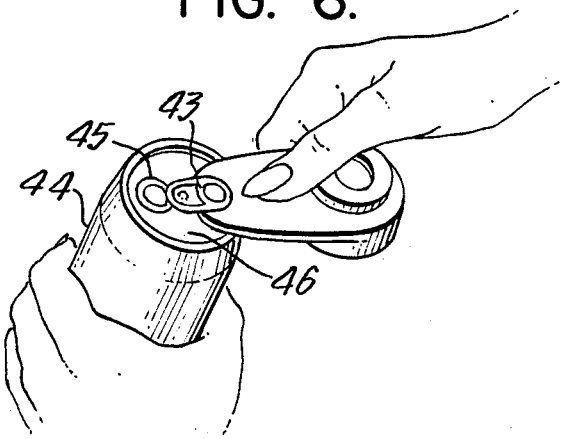
FIG. 6 is a perspective view showing the manner of use of the device of the invention in connection with the opening of a beverage can provided with a lift tab opener.

As reflected in FIG. 6, the tapered extremity 13 of the handle is designed to be slipped under a lift tab 43 of a conventional tab-opening soda ca 44. After sliding the tapered portion of the handle underneath the lift tab 43, the handle may be pried upwardly to raise the lift tab 43 and cause the break-away portion 45 of the can lid o be released. Once the lift tab 43 is raised sufficiently from the surface of the can lid 46, it may be easily gripped and manipulated by the fingers, without concern for breaking fingernails or otherwise causing discomfort.

Certain styles of plastic jugs for milk, and other liquids, ar provided with a form of tamper-resistant cap in which the cap is released by means of a plastic pull tab. To facilitate opening caps of this design, the device of the invention includes a small, rigid, tab-like projection 47, which extends a short distance beyond the end extremity of the handle 12, in the central portion thereof. The tab projection 47, which is quite narrow (e.g., 0.15") can be inserted into a slot at the end of the opener tab and twisted to break the tab free. Thereafter, the opener tab can be easily pulled and removed to free the cap from the jug. It will be noted, in this respect, that the relatively narrow projecting tab 47 extends from a much broader blunt end of the handle, so that twisting of the handle after inserting the tab, applies breaking stress to the pull tab opener of the container.

The device of the invention, although having multiple advantageous uses, is simple and compact, and is easily and inexpensively manufactured. It is thus ideally suited for the end use intended. Because of its simplicity, compactness, and low cost, the device of the invention can be ubiquitously utilized as a kitchen appliance, camping and picnicking utensil, etc.

It should be understood, of course, that the specific form of the invention herein illustrated and described is intended to be representative only as certain changes may be made therein without departing from the clear teachings of the disclosure. Accordingly, reference should be made to the following appended claims in determining the full scope of the invention.

I claim:

1. An opening device, for opening a tamper-resistant container cap of molded plastic construction, and wherein the container cap comprises a threaded cap portion for closing the container, an annular locking collar adjacent the lower edge of the cap portion and arranged to be tamper-resistantly secured to the container, aid locking collar being of greater diameter than said cap portion, circumstantially spaced-apart connector elements extending outwardly from said cap portion and joining said cap portion with said locking collar, said connector elements being arranged to be ruptured by the application of twisting torque to said cap portion, which comprises (a) a guide member of a size and shape to be receivable over said cap portion, (b) said guide member being rotatable relative to said locking collar, generally about the axis of said locking collar, when said guide member is received over said cap portion, (c) a plurality of circumstantially spaced-apart lug elements projecting downward from said guide member and arranged, when said guide member is received over said cap portion, to project through the spaces separating adjacent connector elements, and (d) means associated with said guide member enabling manual gripping of said guide member for the application of torque, thereto in order to rupture said connector elements and free said cap portion for easy removal from said container.

2. An opening device according to claim 1, further characterized by, (a) said guide member comprising an inverted cup-like member provided with a generally circular , downwardly opening cavity to receive said cap portion, (b) said guide member having lower edge abutment means engageable with said connector elements and/or said locking collar when said guide member is received over said cap portion, and (c) said lug elements projecting downward from said abutment means.

3. An opening device according to claim 1, further characterized by, (a) said guide member comprising an inverted cup-like member provided with a generally circular cavity to receive said cap portion, (b) said cavity being at least slightly greater in diameter than said cap portion to enable said guide member to be rotated freely relative to said cap portion.

4. An opening device according to claim 1, further characterized by, (a) a handle portion integrally joined with said guide member and extending radially therefrom to enable increased twisting torque to be applied to said guide member.

5. An opening device according to claim 2, further characterized by, (b) said inverted cup-like member constituting a first cuplike member and having in its upper portion a concentric recess forming a second cup-like member (c) said second cup-like member being o a diameter smaller than the diameter of said first cup-like member and of a size suitable for gripping the sides of a standard twist-off bottle cap, (d) said second cup-like member having a generally circular side wall provided with radially inwardly projecting ribs for effectively interlocking engagement with the sides of said twist-off bottle cap.

6. An opening device according to claim 5, further characterized by, (a) a handle portion integrally joined with said guide member and extending radially therefrom to enable increased twisting torque to be applied to said guide member.

7. An opening device according to claim 5, further characterized by, (a) said second cup-like member having an upper wall provided with a through opening, (b) said through opening being of a size and shape to accommodate finger entry to facilitate removal of a twist-off cap after removal from its container.

8. An opening device according to claim 6, further characterized by, (a) said handle member having at its outer extremity a portion of reduced thickness adapted to be engaged under the lift tab of a standard soda can or the like, enabling said lift tab to be partially raised by lifting/prying action of said handle member.

9. An opening device according to claim 8, further characterized by, (a) said portion of reduced thickness being located in the lateral center portion of said handle member and having portions of greater thickness extending laterally along each side thereof.

10. An opening device according to claim 8, further characterized by, (a) an integral, outwardly extending tab being provided at the end extremity of said portion of reduced thickness, (b) said tab being of substantially narrower lateral dimensions than the lateral dimensions of said portion of reduced thickness.

* * * * *